US008739840B2

(12) United States Patent
Mattos, Jr. et al.

(10) Patent No.: US 8,739,840 B2
(45) Date of Patent: Jun. 3, 2014

(54) METHOD FOR MANAGING ORDERS AND DISPENSING BEVERAGES

(75) Inventors: Louis Mattos, Jr., Douglasville, GA (US); Qiuchen Peter Zhang, Alpharetta, GA (US); Nilton Antonio Moreira Mattos, Roswell, GA (US); Arthur G. Rudick, Atlanta, GA (US); H. Brock Kolls, Alpharetta, GA (US)

(73) Assignee: The Coca-Cola Company, Atlanta, GA (US)

( * ) Notice: Subject to any disclaimer, the term of this patent is extended or adjusted under 35 U.S.C. 154(b) by 524 days.

(21) Appl. No.: 12/767,050

(22) Filed: Apr. 26, 2010

(65) Prior Publication Data

US 2011/0264285 A1 Oct. 27, 2011

(51) Int. Cl.
*B65B 1/30* (2006.01)

(52) U.S. Cl.
USPC ..... 141/94; 700/235

(58) Field of Classification Search
USPC ..... 141/94; 221/96; 700/235, 237
See application file for complete search history.

(56) References Cited

U.S. PATENT DOCUMENTS

| | | | |
|---|---|---|---|
| 4,487,333 | A | 12/1984 | Pounder et al. |
| 4,753,370 | A | 6/1988 | Rudick |
| 4,779,761 | A | 10/1988 | Rudick et al. |
| 4,793,520 | A | 12/1988 | Gerber |
| 4,821,925 | A | 4/1989 | Wiley et al. |
| 4,827,426 | A | 5/1989 | Patton et al. |
| 4,830,511 | A | 5/1989 | Smazik |
| 4,860,923 | A | 8/1989 | Kirschner et al. |
| 4,881,663 | A | 11/1989 | Seymour |
| 4,889,148 | A | 12/1989 | Smazik |
| 4,923,093 | A | 5/1990 | Gerber |
| 4,934,567 | A | 6/1990 | Vahjen et al. |
| 4,938,387 | A | 7/1990 | Kervefors et al. |
| 4,955,507 | A | 9/1990 | Kirschner et al. |
| 5,058,630 | A | 10/1991 | Wiley et al. |
| 5,083,591 | A | 1/1992 | Edwards et al. |
| 5,154,586 | A | 10/1992 | Rudick |
| 5,203,387 | A | 4/1993 | Howlett et al. |
| 5,292,030 | A | 3/1994 | Kateman et al. |
| 5,303,846 | A | 4/1994 | Shannon |
| 5,341,957 | A | 8/1994 | Sizemore |

(Continued)

FOREIGN PATENT DOCUMENTS

| | | |
|---|---|---|
| AT | 319795 | 1/1975 |
| DE | 3709155 | 10/1987 |

(Continued)

OTHER PUBLICATIONS

Author: Tim O'Brien; Title: "Disney Looks to 'Fill' Needs of Guests with Refill Soft Drink Mugs", Dated: Aug. 26, 2002, pp. 1-2.

(Continued)

*Primary Examiner* — Jason K Niesz
(74) *Attorney, Agent, or Firm* — Sutherland Asbill & Brennan LLP

(57) ABSTRACT

A method for managing orders and dispensing products into a container. The method may include the steps of prompting a user selection of a product type at an order entry station, printing indicia on the container indicating at least the product type selected, reading the indicia at a product dispensing station, and dispensing the product type selected into the container.

10 Claims, 6 Drawing Sheets

(56) References Cited

U.S. PATENT DOCUMENTS 5,433,967 A 7/1995 Kateman et al.
5,465,870 A 11/1995 Sizemore
5,473,909 A 12/1995 Kateman et al.
5,507,415 A 4/1996 Sizemore
5,566,732 A 10/1996 Nelson
5,575,405 A 11/1996 Stratton et al.
5,588,557 A 12/1996 Topar
5,603,257 A 2/1997 Kateman et al.
5,690,252 A 11/1997 Oleksiewicz et al.
5,704,350 A 1/1998 Williams, III
5,725,125 A 3/1998 Bessette et al.
5,727,713 A 3/1998 Kateman et al.
5,758,571 A 6/1998 Kateman et al.
5,778,761 A 7/1998 Miller
5,803,320 A 9/1998 Cutting et al.
5,868,065 A 2/1999 Haggerty et al.
5,878,964 A 3/1999 Hansen
5,890,626 A 4/1999 Wolski et al.
5,960,997 A 10/1999 Forsythe
5,975,365 A 11/1999 Hsieh
5,980,969 A 11/1999 Mordini et al.
5,997,928 A 12/1999 Cozer et al.
6,053,359 A 4/2000 Goulet et al.
6,100,518 A * 8/2000 Miller ..... 250/222.1
6,126,983 A 10/2000 Miller
6,170,707 B1 1/2001 Wolski et al.
6,173,862 B1 1/2001 Buca et al.
6,186,193 B1 2/2001 Phallen et al.
6,223,948 B1 5/2001 Davis
6,350,484 B1 2/2002 Ault
6,394,153 B2 5/2002 Skell et al.
6,421,583 B1 7/2002 Sudolcan et al.
6,435,375 B2 8/2002 Durham et al.
6,446,834 B2 9/2002 Davis et al.
6,496,752 B2 12/2002 Sudolcan et al.
6,536,626 B2 3/2003 Newman et al.
6,550,641 B2 4/2003 Newman et al.
6,550,642 B2 4/2003 Newman et al.
6,578,763 B1 6/2003 Brown
6,588,725 B1 7/2003 Wisnieski et al.
6,597,969 B2 7/2003 Greenwald et al.
6,600,968 B2 7/2003 Sudolcan et al.
6,600,969 B2 7/2003 Sudolcan et al.
6,650,962 B2 11/2003 Sudolcan et al.
6,669,053 B1 12/2003 Garson et al.
6,685,059 B2 2/2004 Jones et al.
6,689,410 B2 2/2004 Gerber
6,694,748 B2 2/2004 Sergio et al.
6,698,228 B2 3/2004 Kateman et al.
6,705,356 B2 3/2004 Barton et al.
6,726,062 B2 4/2004 Segiet
6,745,595 B1 6/2004 Kateman et al.
6,751,525 B1 6/2004 Crisp, III
6,756,069 B2 6/2004 Scoville et al.
6,759,072 B1 7/2004 Gutwein et al.
6,763,860 B2 7/2004 Jungmann et al.
6,766,656 B1 7/2004 Crisp, III et al.
6,907,741 B2 6/2005 Kateman
6,934,602 B2 8/2005 Sudolcan et al.
6,941,858 B2 9/2005 Kateman
6,952,928 B2 10/2005 Kateman et al.
6,957,125 B1 10/2005 Rifkin
6,968,876 B2 11/2005 Yacko et al.
6,983,863 B2 1/2006 Santy, Jr.
6,994,231 B2 2/2006 Jones
7,077,290 B2 7/2006 Bethuy et al.
7,108,024 B2 9/2006 Navarro
7,108,156 B2 9/2006 Fox
7,147,131 B2 12/2006 Sher et al.
7,156,115 B2 1/2007 Everett et al.
7,156,259 B2 1/2007 Bethuy et al.
7,159,743 B2 1/2007 Brandt et al.
7,162,391 B2 1/2007 Knepler et al.
7,164,966 B2 1/2007 Sudolcan
7,168,593 B2 1/2007 Schroeder et al.
7,203,572 B2 4/2007 Crisp, III
7,243,818 B2 7/2007 Jones
7,320,416 B2 1/2008 Miller et al.
7,325,485 B2 2/2008 Carhuff et al.
7,331,483 B2 2/2008 Bhimani
7,347,344 B2 3/2008 Engels et al.
7,353,080 B2 4/2008 Walker et al.
7,383,966 B2 6/2008 Ziesel
7,387,239 B2 6/2008 Thomas et al.
7,428,824 B1 9/2008 Malachowsky et al.
7,439,859 B2 10/2008 Humphrey
7,445,133 B2 11/2008 Ludovissie et al.
7,578,415 B2 8/2009 Ziesel et al.
7,617,850 B1 11/2009 Dorney
7,624,922 B2 12/2009 Brown
7,648,050 B1 1/2010 Ehlers
7,740,152 B2 6/2010 Hughes et al.
7,757,896 B2 7/2010 Carpenter et al.
7,845,375 B2 12/2010 Dorney
7,913,879 B2 3/2011 Carpenter et al.
8,056,588 B2 11/2011 Somerby
8,151,832 B1 4/2012 Dorney
8,162,181 B2 4/2012 Carpenter et al.
8,181,824 B2 5/2012 Ziesel et al.
8,453,879 B2 6/2013 Carpenter et al.
2003/0012864 A1 1/2003 Gerber
2003/0014210 A1 1/2003 Vock et al.
2003/0097314 A1 5/2003 Crisp, III et al.
2003/0136837 A1 7/2003 Amon et al.
2003/0227820 A1 12/2003 Parrent
2004/0026447 A1 2/2004 Badin et al.
2004/0026452 A1 2/2004 Santiago et al.
2004/0040983 A1 3/2004 Ziesel
2004/0071841 A1 4/2004 Carhuff et al.
2004/0103033 A1 5/2004 Reade et al.
2004/0170727 A1 9/2004 Howard et al.
2004/0217129 A1 11/2004 Roekens et al.
2004/0254837 A1 12/2004 Roshkoff
2005/0015348 A1 1/2005 Knepler
2005/0029287 A1 * 2/2005 Mobbs ..... 222/1
2005/0087255 A1 4/2005 Humphrey et al.
2005/0121466 A1 6/2005 Sher et al.
2005/0166761 A1 8/2005 Jones et al.
2005/0166766 A1 8/2005 Jones et al.
2005/0175767 A1 8/2005 Gerber
2005/0178793 A1 8/2005 Cheng et al.
2005/0201196 A1 9/2005 Gerber
2005/0212755 A1 9/2005 Marvit
2005/0252933 A1 11/2005 Manisco
2005/0269360 A1 12/2005 Piatnik et al.
2005/0284885 A1 12/2005 Kadyk et al.
2006/0036454 A1 2/2006 Henderson
2006/0054614 A1 3/2006 Baxter et al.
2006/0076402 A1 4/2006 Lerch et al.
2006/0081653 A1 4/2006 Boland et al.
2006/0113323 A1 6/2006 Jones
2006/0151529 A1 7/2006 Crisp, III
2006/0157504 A1 7/2006 Barker et al.
2006/0172056 A1 8/2006 Tobin et al.
2006/0174778 A1 8/2006 Greiwe
2006/0180610 A1 8/2006 Haskayne
2006/0191964 A1 8/2006 Ziesel
2006/0213928 A1 9/2006 Ufheil et al.
2006/0238346 A1 10/2006 Teller
2006/0261156 A1 * 11/2006 Brown ..... 235/381
2007/0009365 A1 1/2007 Litterst et al.
2007/0051747 A1 3/2007 Landers et al.
2007/0114244 A1 5/2007 Gatipon et al.
2007/0205221 A1 9/2007 Carpenter et al.
2007/0212468 A1 9/2007 White et al.
2007/0215239 A1 9/2007 Dorney
2007/0251260 A1 11/2007 Baxter et al.
2007/0255450 A1 11/2007 Mazur et al.
2007/0272317 A1 11/2007 Klopfenstein et al.
2008/0004954 A1 1/2008 Horvitz
2008/0004973 A1 1/2008 Rothschild
2008/0023488 A1 1/2008 Guerrero et al.
2008/0029541 A1 2/2008 Wallace et al.
2008/0041876 A1 2/2008 Frank et al.

(56) References Cited

U.S. PATENT DOCUMENTS

| | | | | |
|---|---|---|---|---|
| 2008/0050480 | A1 | 2/2008 | Doglioni Majer | |
| 2008/0126928 | A1 | 5/2008 | de Leon | |
| 2008/0142548 | A1 | 6/2008 | Moen et al. | |
| 2008/0148948 | A1 | 6/2008 | Evers et al. | |
| 2009/0040050 | A1 | 2/2009 | Humphrey | |
| 2009/0065520 | A1 | 3/2009 | Peters et al. | |
| 2009/0065570 | A1 | 3/2009 | Peters et al. | |
| 2009/0069930 | A1 | 3/2009 | Peters et al. | |
| 2009/0069947 | A1 | 3/2009 | Newman | |
| 2009/0113513 | A1 | 4/2009 | Dorney | |
| 2009/0152345 | A1* | 6/2009 | Johnson | 235/381 |
| 2009/0205747 | A1 | 8/2009 | Lillard | |
| 2009/0254215 | A1 | 10/2009 | Hyde et al. | |
| 2010/0015558 | A1 | 1/2010 | Jarvis et al. | |
| 2010/0100849 | A1 | 4/2010 | Fram | |
| 2010/0125362 | A1 | 5/2010 | Canora et al. | |
| 2011/0022225 | A1 | 1/2011 | Rothschild | |
| 2011/0049180 | A1 | 3/2011 | Carpenter et al. | |
| 2011/0163126 | A1 | 7/2011 | Carpenter et al. | |
| 2011/0260828 | A1 | 10/2011 | Zhang et al. | |
| 2013/0248560 | A1 | 9/2013 | Carpenter et al. | |

FOREIGN PATENT DOCUMENTS

| | | |
|---|---|---|
| EP | 0083467 | 7/1983 |
| EP | 0104447 | 4/1984 |
| EP | 0105017 | 4/1984 |
| EP | 0112638 | 7/1984 |
| EP | 0136005 | 4/1985 |
| EP | 0158096 | 10/1985 |
| EP | 0175815 | 4/1986 |
| EP | 0448598 | 10/1991 |
| EP | 0786948 | 8/1997 |
| EP | 0958234 | 11/1999 |
| EP | 1117612 | 7/2001 |
| EP | 1460029 | 9/2004 |
| EP | 1905730 | 4/2008 |
| FR | 262844 | 6/1989 |
| GB | 2303354 | 2/1997 |
| GB | 2429694 | 7/2007 |
| GB | 2442223 | 4/2008 |
| JP | 09134481 | 5/1997 |
| JP | 2003506273 | 2/2003 |
| RU | 2202511 | 10/2001 |
| WO | 8809766 | 12/1988 |
| WO | 9850165 | 11/1998 |
| WO | 0065316 | 11/2000 |
| WO | 0068136 | 11/2000 |
| WO | 02057178 | 7/2002 |
| WO | 02059035 | 8/2002 |
| WO | 03107110 | 12/2003 |
| WO | 2004036515 | 4/2004 |
| WO | 2005018788 | 3/2005 |
| WO | 2005068836 | 7/2005 |
| WO | 2005070816 | 8/2005 |
| WO | 2005102906 | 11/2005 |
| WO | 2005111955 | 11/2005 |
| WO | 2006012916 | 2/2006 |
| WO | 2006013362 | 2/2006 |
| WO | 2006019523 | 2/2006 |
| WO | 2006070257 | 7/2006 |
| WO | 2006076733 | 7/2006 |
| WO | 2007002575 | 1/2007 |
| WO | 2007011830 | 1/2007 |
| WO | 2007070032 | 6/2007 |
| WO | 2008015097 | 2/2008 |

OTHER PUBLICATIONS

Eric Sforza. "The Genius and Failure of Coca-Cola Freestyle." Innovation Excellence <http://www. innovationexcellence.com/blog/2012/01/07/the-genius-and-failure-of-coca-cola-freestyle/>. Jan. 7, 2012. 3 pages.

"Coca-Cola Freestyle Launches Virtually on Facebook." Coca-Cola Press Center—Company Articles <http://www. thecoca-colacompany.com/dynamic/press_center/2011/09/coca-cola-freestyle-launches-virtually-on-facebook-html>. 2 pages.

Lancer, Redirect your store traffic from the cooler to your more profitable post-mix fountain area by adding fun and creating excitement!; FS Series (Apr. 2003); pp. 4.

* cited by examiner

METHOD FOR MANAGING ORDERS AND DISPENSING BEVERAGES

CROSS-REFERENCE TO RELATED APPLICATIONS

This application contains subject matter that is related to the subject matter of the following co-pending applications, each of which is assigned to the same assignee as this application, The Coca-Cola Company, Atlanta, Ga., U.S.A. Each of the following applications is hereby incorporated herein by reference in its entirety: "VESSEL ACTIVATED BEVERAGE DISPENSER", application Ser. No. 12/767,048, filed herewith, and "METHOD OF PRINTING INDICIA ON VESSELS TO CONTROL A BEVERAGE DISPENSER", application Ser. No. 12/767,049, filed herewith.

TRADEMARKS

The mark COCA-COLA® is a registered trademark of The Coca-Cola Company of Atlanta, Ga., U.S.A. Other marks used herein may be registered trademarks, tradenames, or product names of The Coca-Cola Company or other companies.

TECHNICAL FIELD OF THE INVENTION

This application relates generally to a method for managing orders and dispensing products, such as beverage products, pharmaceutical products, or any other products that can be dispensed and more particularly relates to a method of placing an order at an order entry station, prompting a user to select a product type, printing indicia on the container into which the product will be dispensed, indicating at least the product type selected, relocating the container to a product dispensing station, reading the indicia at the product dispensing station, configuring the product dispensing station to dispense the product type selected based in part on the indicia, and dispensing the product type selected into the container.

BACKGROUND OF THE INVENTION

Ordering and filling a beverage order at a quick or full serve restaurant often may not be a managed task. A crew member simply may hand a consumer an empty cup. The consumer then has to use a self serve beverage dispenser to select and fill the cup. The quick or full serve restaurant generally has no way of knowing which beverage product the consumer selected or how many times the consumer refilled the cup. The quick or full serve restaurant also may have no way of linking the consumer's beverage selections to the original food and beverage order. As such, there is little opportunity to manage and collect information related to consumer beverage consumption in a self server beverage environment.

Moreover, the crew member may fill the cup with the wrong beverage, may associate the filled cup with the incorrect order, or simply may misinterpret the consumer's selection while trying to execute simultaneous orders. When a consumer orders several different beverages for a family or a group of friends, no one may know which drink belongs to whom. Looking inside the cup may be of no help as many beverages are the same color. One then needs to sip the different drinks to determine which beverages are which.

A crew member in a quick or full serve restaurant environment also may need two hands to operate the beverage dispenser. Such two handed operation may slow down the serving time by the crew member. In this regard, having to stop long enough to navigate a graphical user interface to select a beverage type from a beverage menu and then position and hold a cup while filling may take an extended period of time. Such time may negatively impact the rate at which consumers may be serviced by the crew member.

Another issue is that the crew member may have to put down what he or she is carrying to free a hand to operate the beverage dispenser. Space may be at a premium in quick or full serve restaurant environments. Having to put down food orders to fill beverages may lead to awkwardly having to stack food, place food where it does not belong, and/or balance food trays so as to free both hands to select and fill the beverage cups.

There thus may be a need for a method of managing orders and dispensing beverages in a quick or full serve restaurant environment. In this regard, food and beverage order speed and accuracy may need to be improved so as to satisfy the consumer. There also may be a need to provide a consumer interface that increases the usability of a beverage dispenser for children and other consumers as well as increases the usability of beverage dispensers for crew members. There also may be a need to better inform consumers of what is in the consumer's cup, particularly when a consumer orders several different kinds of beverages at the same time. There also may be a need to increase the speed and efficiency of the crew member in selecting and filling the beverage cups.

SUMMARY OF THE INVENTION

The present application thus provides a method for managing orders and dispensing products, such as beverages, into a container or vessel. The method may include the steps of prompting a user selection of a product type at an order entry station, printing indicia on the container indicating at least the product type selected, reading the indicia at a product dispensing station, and dispensing the product type selected into the container.

The present application further provides a method for managing orders and dispensing beverages into a vessel. The method may include the steps of placing an order at an order entry system, the order including an order identification, printing indicia on the vessel including the order identification, providing the vessel to a consumer, reading the indicia at a beverage dispensing station, allowing the consumer to select a beverage type, dispensing the beverage type into the vessel, and communicating the order identification and the beverage type selected to the order entry system.

The present application further provides a method of using a vessel as graphical user interface pointing device on fountain dispensers. The method may include placing the vessel proximate to a vessel motion detector, monitoring, by way of the vessel motion detector, vessel rotational or other motion, enabling a user to interact with a graphical user interface based via the vessel motion detector, allowing the user to select a beverage type from a menu of beverages, and dispensing the beverage type selected into the vessel.

BRIEF DESCRIPTION OF THE FIGURES

The subject matter herein is particularly pointed out and distinctly claimed in the claims at the conclusion of the specification. The foregoing and other objects, features, and advantages of the present application may be apparent to one of ordinary skill in the art from the following detailed description taken in conjunction with the accompanying drawings.

The detailed description explains the preferred embodiments of the application, together with advantages and features, by way of example with reference to the drawings.

DETAILED DESCRIPTION OF THE INVENTION

Figure 1A:
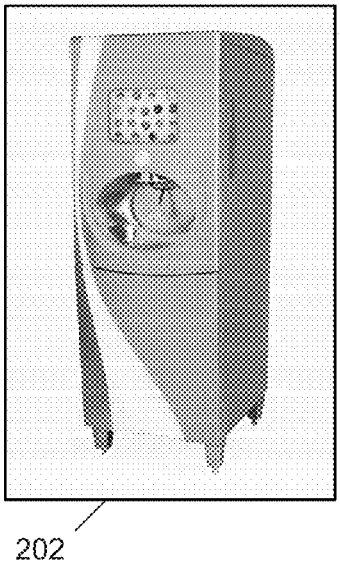
FIG. 1A illustrates one example of a micro-dosing beverage dispensing station including an interface portion of the micro-dosing beverage dispensing station.
Figure 1B:
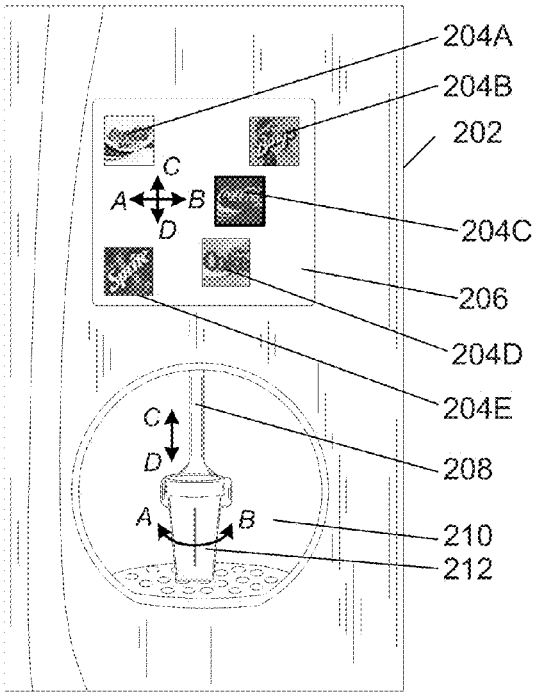
FIG. 1B illustrates one example of a micro-dosing beverage dispensing station including an interface portion of the micro-dosing beverage dispensing station.

Turning now to the drawings in greater detail, it will be seen that in FIGS. 1A and 1B there is a micro-dosing beverage dispensing station 202. The micro-dosing beverage dispensing station 202 may manage the dispensing of a number of concentrated ingredients, water, dairy, soy, sweetener, carbonated water, and/or other beverage forming ingredients in precise recipes to form hundreds of different beverages. To effectuate the ability of a user to select which beverage recipe to dispense, a user accessible graphical user interface 206 may be provided. In this regard, a menu of beverage choices may be displayed on the graphical user interface 206 such as beverage selections 204A-204E.

For example and not as a limitation, a COCA-COLA ZERO™ beverage may be dispensed by selecting the COCA-COLA ZERO™ beverage selection 204A. In a similar fashion, a BARQ'S ROOT BEER® beverage may be dispensed by selecting the BARQ'S ROOT BEER® beverage selection 204B. A COCA-COLA® beverage may be dispensed by way of the beverage selection 204C, a DIET COKE® beverage may be dispensed by way of the beverage selection 204D, and a SPRITE® beverage may be dispensed by way of the beverage selection 204E. The beverage dispenser 202 may be configured to dispense hundreds of beverage types limited only by the ingredients needed to formulate a beverage recipe.

To facilitate the selection of the beverage type from the graphical user interface 206, a user generally was required to touch a touch screen. If the user's hands were full, this would require the user to put something down in order to free a hand to then make a beverage type selection. In certain other situations, the location of the touch screen may be too high for easy access by children or other types of consumers.

An advantage herein is that an additional user interface device 300 may be implemented to facilitate the ability to select and optionally dispense a beverage type. In this regard, the beverage dispenser 202, a beverage dispense region 210, an ice dispense lever 208, a beverage dispense lever 216 (shown in FIG. 2A) and/or locations that may have the user interface device 300 (shown in FIG. 3) capable of detecting the motion of a vessel 212. As is illustrated in FIG. 1B, a user may rotate the vessel 212 to move the selection on the graphical user interface 206 in the "A-B" direction. The user also may move the vessel 212 in the up or down direction to move the selection of the graphical user interface 206 in the "C-D" direction. For purposes herein, the user interface device 300 also may be referred to as a system 300. Alternatively, and to avoid the need to rotate the vessel 212, the vessel 212 may be provided with machine readable indicia 400E that, rather than only partially encircles the vessel 212, encircles the entire perimeter of the vessel 212 such that the user interface device 300 can read the indicia no matter what direction the vessel 212 is positioned.

This one handed user interface is an alternative to having to touch the touch screen 206 and thus effectuates that ability to select and optionally dispense the desired beverage. In a number of examples, this one handed beverage selection interface speeds beverage selection and dispense time in the crew-serve environment commonly found in quick or full serve restaurant environments. In general, a "crew-serve" dispenser is operated by a "crew member" and a "self-serve" dispenser is operated by a consumer. The one handed operation frees the crew members from having to put down what they are carrying so as to select and dispense a beverage. In another example, children and other consumers that may be unable to reach the elevated graphical user interface 206 may make and optionally dispense a beverage selection by using only vessel motion to interact with the beverage dispenser. In another example, wheelchair-bound consumers or others have difficulty reaching the elevated graphical user interface 206 also may benefit from being able to select and dispense a beverage using only vessel motion to interact with the beverage dispenser.

Figure 2A:
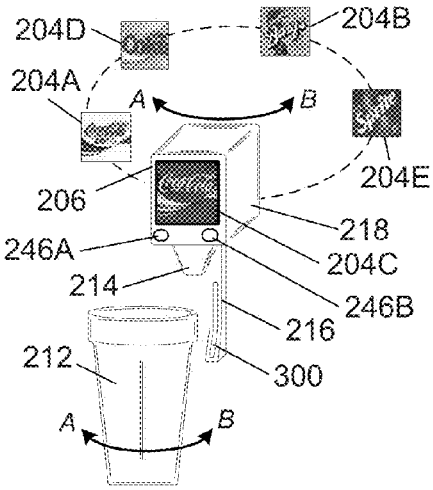
FIG. 2A illustrates one example of an interface portion of a beverage dispenser valve having a graphical user interface.
Figure 2B:
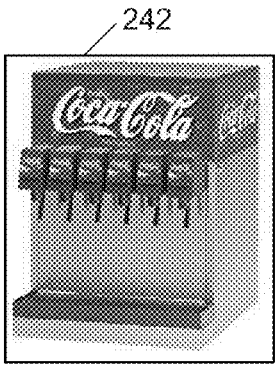
FIG. 2B illustrates one example of a known beverage dispenser valve.

Referring to FIG. 2A, there is illustrated one example of an interface portion of a beverage dispenser having the graphical user interface 206. In a conventional fountain dispenser 242 shown in FIG. 2B, a number of single flavor valves were orientated such that a user could only choose between finite numbers of beverage flavors. Embodiments of the conventional fountain dispensers typically support a dozen or less valves and as such a finite number of beverage type choices.

An advantage herein is that a single valve 218 may be configured with the graphical user interface 206. The dispenser lever 216 may be configured with the user interface device 300 such that a user may interact with the beverage valve to select a beverage type and then dispense the beverage into the vessel 212. In this regard, a user may move or rotate the vessel 212 in the "A-B" direction causing the beverage type to change on the graphical user interface 206. As the user rotates the vessel 212 in the "A" direction, the graphical user interface 206 displaying the flavor label changes from COCA-COLA® 204C to SPRITE® 204E to BARQ'S ROOT BEER® 204B to DIET COKE® 204D to COCA-COLA ZERO™ 204A and then back to COCA-COLA® 204C. Rotation of the vessel in the "B" direction reverses the flavor display pattern. The user thus has the ability to use the vessel 212 to select a beverage type and then dispense the beverage by activating the lever 216. Also shown in FIG. 2A are a beverage dispenser nozzle 214 and a number of touch buttons 246A-B. The touch buttons 246A-B may effectuate the ability of a user to interact with the valve 218 and optionally dispense the beverage by touch.

Figure 6:
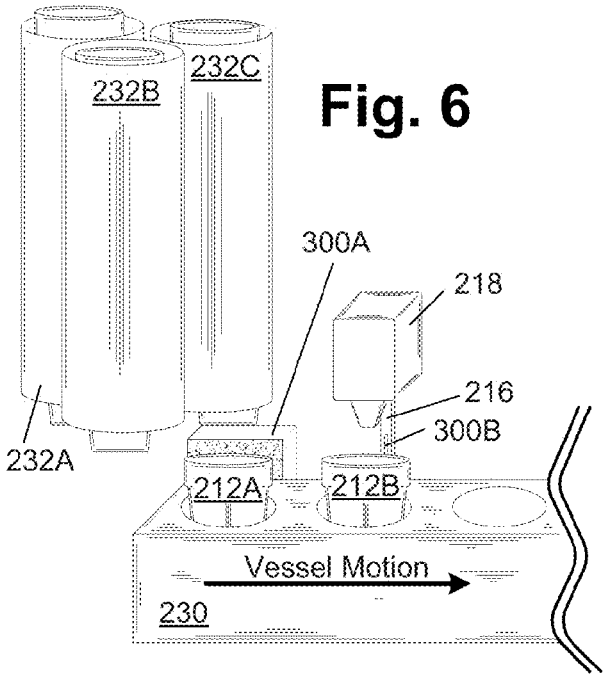
FIG. 6 illustrates one example of a user interface device, vessel activated, configured as an automated beverage system.

The valve 218 may be retrofit to a conventional fountain dispenser 242 or an automated beverage dispenser 230 (shown in FIG. 6). In this regard, the valve 218 having the graphical user interface 206 may be incorporated into existing conventional fountain equipment and automated beverage systems so as to effectuate the ability to select and dispense numerous beverages from the single valve 218 with the use of a user interface device 300.

Figure 3:
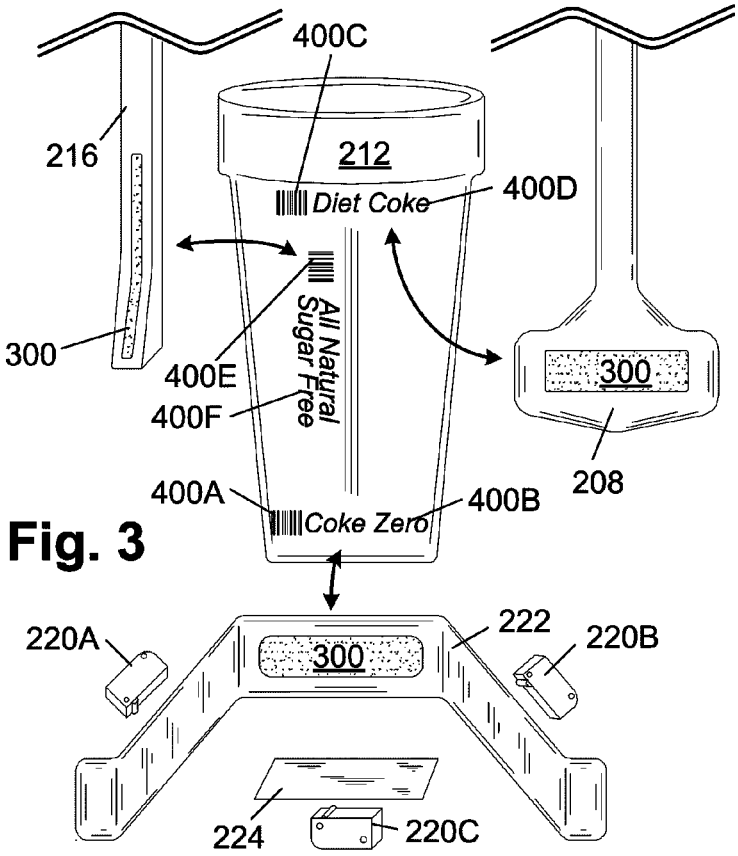
FIG. 3 illustrates one example of a number of interfaces capable of effectuating the ability to select and initiate the dispensing of a beverage from a beverage dispensing station.

Referring to FIG. 3, there is illustrated one example of a number of interfaces capable of effectuating the ability to select and initiate the dispensing of a beverage from a beverage dispensing station. The user interface device 300 may be incorporated into the dispense lever 216, the ice lever 208, or into the beverage dispense area using a dispense area lever 222, a dispense plate 224 or another device. As the vessel 212 comes into proximity of the system 300, the vessel motion may be detected and used to facilitate a selection of a beverage type on the graphical user interface 206. Once the beverage type has been selected, dispensing may be initiated by pressing the lever 216, the lever 208, actuating a number of switches 220A-C, or otherwise. The levers, switches, combinations thereof, and/or other types of actuators may be referred to as the dispense actuators. In this regard, the dispense actuators may be used to effectuate the dispensing of the beverage type selected. A number of levers such as the levers 208 and 216 may be utilized with the switches 220A-C so as to serve as a dispense actuator to enable a crew member, consumer, or other users to initiate and control dispensing of the beverage.

The switches 220A-C may be actuated by pushing the vessel 212 against the dispense lever 222 or the dispense plate 224. The dispense area lever 222 and the dispense plate 224 may have enough freedom to move such that one of the switches 220A-C may be actuated when the lever or plate are pushed by the vessel 212. In a multi-level menu on the graphical user interface, pushing the vessel 212 against the left side of the dispense area lever 222 and thus actuating the switch 220A may move the graphical user interface display to the next menu level while pushing the vessel 212 against the right side of the dispense area lever 222 and thus actuating the switch 220B may bring the graphical user interface back to the previous menu level.

In addition to detecting the motion of the vessel 212 and using such vessel motion to facilitate a beverage selection and optionally a beverage dispense, the system 300 may be configured to print indicia on the vessel 212. During the beverage selection and/or beverage dispense, a print mechanism 308 (shown in FIG. 4) associated with system 300 may print indicia on the vessel 212. Such indicia may be the type or kind of beverage selected and dispensed, a barcode that is machine readable, health and wellness information, product contents information, and/or other indicia. As an example and not as a limitation, illustrated in the FIG. 3 is a machine readable indicia 400C and product information 400D horizontally oriented as printed by the system 300 associated with the lever 208. Also illustrated in the FIG. 3 is a machine readable indicia 400E and product information 400F vertically orientated as printed by the system 300 associated with the lever 216. Also illustrated in the FIG. 3 is a machine readable indicia 400A and product information 400B horizontality orientated as printed by the system 300 associated with the lever 222. Note that each of these indicia, 400A, 400C, and 400E could each be horizontally oriented at different levels on the vessel 212 (as shown with indicia 400C and 400A, but with the indicia completely encircling the vessel 212 to avoid the need for the user to rotate the indicia 400A, C, or E so it can be read by the user interface device 300 in any orientation. In this application, the user would simply elevate the cup to the desired level so that the desired indicia are read by the user interface device.

Figure 4:
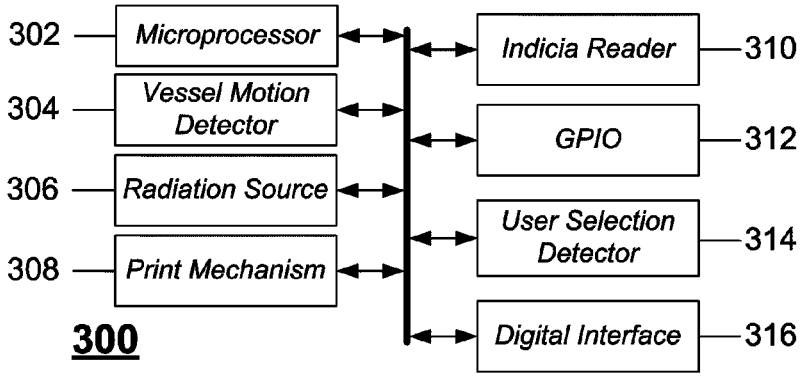
FIG. 4 illustrates one example of a system block diagram for a user interface device for use with a beverage dispenser.

Referring to FIG. 4, there is illustrated one example of a system block diagram for the user interface device 300 for use with the beverage dispenser. The system 300 may be integrated into a beverage dispensing station, a fountain dispenser, an automated beverage system, or other type of a beverage dispenser. Indeed the system may be integrated into any dispensing mechanism for dispensing any type of product, including, without limitation, food products, pharmaceutical products, candy, coffee (including beans and ground), paint, or any other product that can be dispensed and needs to be distinguished from other products that can be dispensed from the same dispensing mechanism. The system 300 may be utilized to effectuate the use of the vessel 212 to select a beverage type and optionally dispense a beverage. In addition, such a system 300 may be utilized to read machine readable indicia and/or print indicia on the vessel surface. Reading such indicia may effectuate the ability to program the dispenser to dispense certain beverage types, control access to the beverage dispensing station, program the beverage dispensing station, and/or effectuate other features.

The system 300 may have a microprocessor 302. Such a microprocessor 302 may be an INTEL, MOTOROLA, AMD, ZILOG, MICROCHIP, RABBIT, and/or other types and kinds of microprocessors, as may be required and/or desired. The microprocessor 302 may be interconnected with a vessel motion detector 304. A radiation source 306 may be used to illuminate a portion of the surface of the vessel 212. The backscatter then may be captured by the vessel motion detector 304. In this regard, the vessel motion detector 304 may determine the motion of the vessel 212 by monitoring the changes in the backscatter. The backscatter also may be referred to as the scatter data. The vessel motion effectuates the ability of the microprocessor 302 to implement instructions that perform the steps of determining the motion of the vessel by analysis of the scatter data, communicating data based in part on the scatter data, and effectuates the ability of the user to rotate or move the vessel to select a beverage type.

The radiation source 306 and the vessel motion detector 304 may be similar in design and manufacture to components found in an optical personal computer mouse or other type of optical pointing device design. In addition, the radiation source and the vessel motion detector may employ visible and non-visible light and/or other radiation sources and detectors. Furthermore, lasers, radio frequency techniques, and/or other radiation sources and/or vessel motion detector techniques and/or components may be employed in the design. Mechanical encoders also may be used in part as a vessel motion detector. The vessel motion detector 304 also may utilize mechanical position detection, rotary encoders, vessel contact means, and/or other vessel motion detection techniques.

Interconnected with the microprocessor 302 may be a print mechanism 308. Such a print mechanism 308 may be configured to print indicia on the surface of the vessel 212, as illustrated in FIG. 3, and/or in other ways. Such a print mechanism 308 may print by way of thermal, ink jet, radiation exposure of reactive inks applied on the vessel surface, and/or by other print methods. The print mechanism 308 may create graphics and text indicia by way of pixel based printing methods such as dot matrix style and/or by way of other type and/or kinds of printing methods.

Interconnected with microprocessor 302 may be an indicia reader 310. The indicia reader 310 may read and process machine readable codes. Such machine readable codes may be a MICROSOFT TAG, a DATAMATRIX CODE, a QRC-CODE, a barcode, graphics, black and white tags, color tags, and/or other types of machine readable indicia.

Interconnected with the microprocessor 302 may be a number of general purpose inputs and outputs (GPIO) 312. In this regard, the microprocessor 302 may read and control external devices by way of the GPIO 312. For example and not as a limitation, the switches 220A-C may be monitored by the GPIO 312. The GPIO 312 also may be used to control lighting around the beverage dispense area 210 or to monitor and control other aspects and devices.

Interconnected with the microprocessor 302 may be a user selection detector 314. The user selection detector 314 may be used to detect the vessel 212 or the motion of the lever 208, the lever 216, and/or the lever 222. In this regard, the user selection detector 314 may be used to detect vessel motion so as to determine that a selection has been made by the user. For example and not as a limitation, the user moves the vessel 212 to select a beverage type. Once the beverage type is selected on the graphical user interface 206, the user can then tap or move the lever 208, the lever 216, and/or the lever 222. Such tapping or lever movement may be detected by the user selection detector 314 and used to confirm the selection the beverage type. In operation, this confirmation of the selected beverage type may be followed by the dispensing of ice, the beverage, and/or other actions. The user selection detector 314 may make use of an accelerometer, switches, and/or other user selection detector devices.

Interconnected with microprocessor 302 may be a digital interface 316. The digital interface 316 may be a universal serial bus (USB) port, a CAN bus interface, an infrared communication port, a serial port, a radio frequency port, or other type or kind of digital communication port. In this regard, the system 300 may be interfaced to and communicate with other digital devices by way of the digital interface 316.

Figure 5:
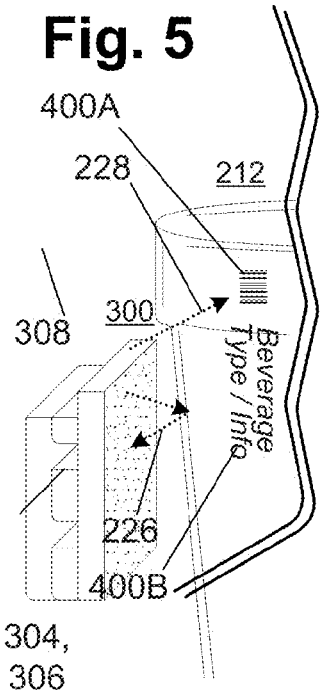
FIG. 5 illustrates one example of a user interface device, vessel activated, for use with a beverage dispenser.

Referring to FIG. 5 there is illustrated one example of the user interface device 300, vessel activated, for use with a beverage dispenser. The radiation source 306 may emit radiation 226 that reflects off the surface of the vessel 212 and may be monitored by the vessel motion detector 304. The vessel motion detector 304 may detect motion of the vessel 212 by way of received reflected radiation off the vessel surface from the radiation source 306 as scatter data associated with the vessel motion. The microprocessor 302 may implement instructions that perform the steps of determining the motion of the vessel by analysis of the scatter data. The data then may be communicated based in part on the scatter data so as to enable the user to interact with the graphical user interface 206. This effectuates the ability of the user to rotate or move the vessel 212 to select a beverage type and dispense the beverage.

The print mechanism 308 may be utilized to print the beverage type, beverage information, machine readable codes, and/or other indicia on the vessel 212. Such printing may be effectuated by way of transfer of ink jet printing, thermal printing, or radiation activated ink exposure with use of a radiation source.

Referring to FIG. 6, there is illustrated one example of the user interface device 300, vessel activated, configured as the automated beverage system 230. An automated beverage system (ABS) 230 may be operationally related to an order entry system. Such an order entry system may be found at a quick or full serve restaurant. In operation, an order placed by way of the order entry system may cause the automated beverage system 230 to dispense a vessel from a vessel dispenser 232A-C and may be filled with a beverage automatically.

Figure 7:
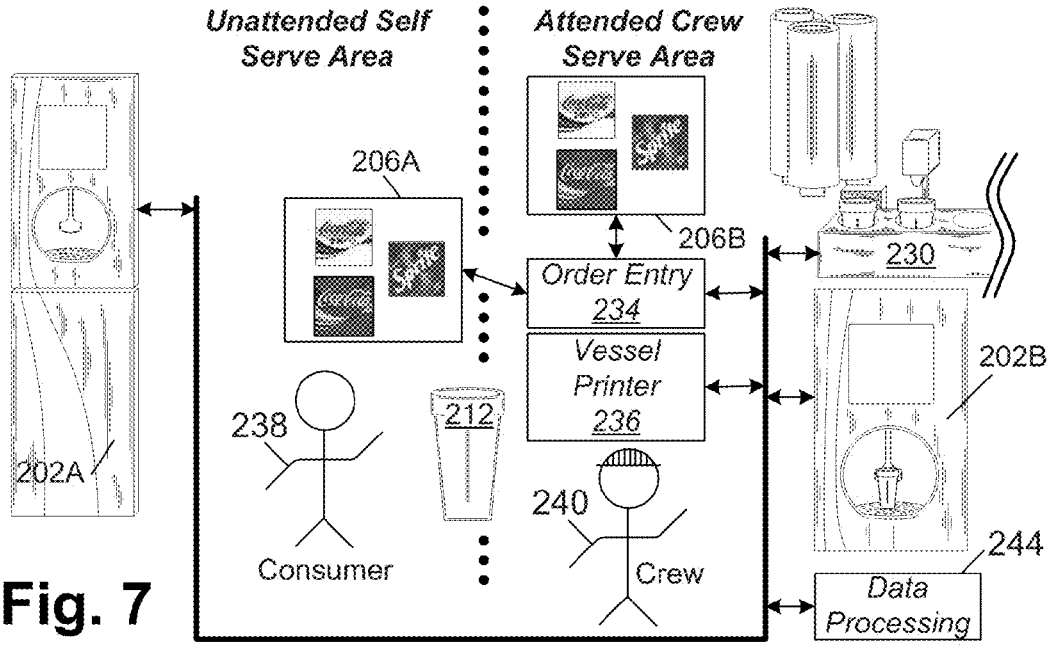
FIG. 7 illustrates one example of a quick or full serve restaurant beverage order entry and fulfillment network.

An advantage herein is that the indicia may be printed on the vessel 212 as initiated by way of an order being placed in the order entry system 234 (shown in FIG. 7). The indicia printed on the vessel 212 may include machine readable indicia, beverage type, and/or other indicia, and may be used to confirm that the vessel is authorized to receive product from the product dispenser. The vessel 212 then may be automatically dispensed from the vessel dispenser 232A-C into a vessel position 212A. The dispensed vessel 212 may have the indicia printed onto the vessel 212 as it is conveyed past the system 300A. Upon reaching a vessel position 212B, the lever 216 having a system 300B positioned thereon may read the indicia, configure the beverage type to be dispensed, and then dispense the beverage into the vessel 212. The indicia on the vessel 212 may be used to determine the beverage type to be dispensed and optionally other beverage parameters such as size, diet sweetener, non-diet sweetener, and/or the indicia that may be used to determine other aspects or features. The vessel dispenser 232A-C may be configured for small size vessels 232A, medium size vessels 232B, large size vessels 232C, and/or configured in other ways.

An advantage herein is that not only may the printed indicia be utilized to configure the beverage dispensing stations 202A-B, the beverage valves 218, and the automated beverage systems 230 to dispense a desired beverage type, but the indicia also may play a role in insuring order accuracy and consumer satisfaction. In this regard, by printing the beverage type on the surface of the vessel 212, the crew member may ensure that the consumer receives the correct beverage. Likewise if a consumer is purchasing several drinks, perhaps belonging to several family members, the humanly readable indicia 400B, D, and F printed on the surface of the vessel 212 ensures that each family member receives the correct beverage type. A fountain dispenser, the automated beverage system 230, the beverage dispensing station 202A-B, and the beverage dispenser may be referred to as a beverage dispenser, a beverage dispensing station, and/or crew-serve beverage dispenser.

Referring to FIG. 7, there is illustrated one example of a quick or full serve restaurant beverage order entry and fulfillment network. A consumer 238 may place an order with a crew member 240. Such an order may be placed in an order entry system 234. The order placement may require that the crew member select the beverage type desired by the consumer by way of a graphical user interface 206B. Alternatively, the consumer may be able to make a beverage selection from a consumer accessible graphical user interface 206A. The beverage dispensing station 202A-B, the automated beverage system 230, the graphical user interfaces 206A-B, the vessel printer 236, and the order entry station 234 may be networked together with a data processing system 244. In this regard, the data processing system 244 may be a local or a global network based data processing resource or a system accessible over a global network. The Internet may be considered a global network. The data processing system 244 may be utilized to effectuate the running of a quick or full serve restaurant including order entry management.

The vessel 212 may be printed and the crew member may hand the vessel 212 to the consumer. The consumer then may use the beverage dispensing station 202A to fill the vessel 212. The indicia printed on the vessel 212 may contain the order identification and the act of the consumer filling the vessel 212 at the beverage dispensing station may cause the indicia to be read including the order identification. Information about what the consumer dispensed into the vessel then may be communicated to the data processing system 244 managing orders such that the beverage information may be added to the order information. In this regard, order information may include the types, kind, and volume of beverage dispensed by the consumer.

This feature overcomes the current shortcomings that when a consumer buys a beverage in a self-serve environment, the crew member adds to the order a drink entry with no details as to what flavor or brand of beverage the consumer is going to consume. In addition, there is no way to track refills in a self-serve environment and as such the order information may be incorrect with respect to the type, kind, and volume of beverage dispensed by the consumer.

The crew-server member may initiate beverage filling by way of the automated beverage system 230. The consumer's order information, beverage type, other product information, and/or other indicia may be printed on the vessel 212 and filled at the automated beverage system 230. The crew member then benefits from having the beverage type, order identification, and/or other indicia printed on the surface of the vessel 212 to ensure that the correct beverage order is provided to the correct consumer. The consumer also benefits in that when they receive the beverages and distribute them to family members, each consumer is ensured that they are getting the correct beverage.

The crew-server member 240 may use the vessel 212 in combination with the user interface device 300 to select quickly a beverage type and dispense the beverage at the beverage dispensing station 202B. In this regard, the vessel 212 may be preprinted and read at the beverage dispensing station 202B and/or may be printed after the crew member 240 selects the desired beverage.

Figure 8:
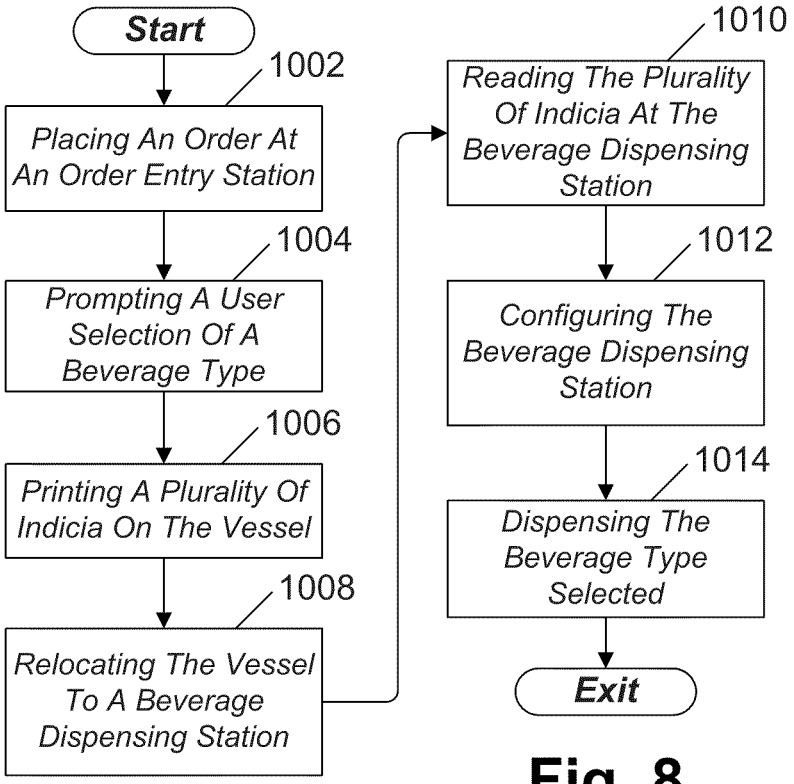
FIG. 8 illustrates one example of a method of selecting and dispensing beverages using a vessel as part of a user interface device.

Referring to FIG. 8, there is illustrated one example of a method for managing orders and dispensing beverages. An order may be place by way of an order entry station in a quick or full serve restaurant environment. The user may be prompted to select a beverage type, the beverage type may be printed on the vessel 212, the vessel 212 may be read in a beverage dispensing station, the beverage dispensing station may be configured, and the selected beverage type may be dispensed into the vessel 212. The beverage dispensing station also may be referred to as an automated beverage system 230. The method begins in block 1002.

In block 1002, an order is placed at an order entry station. In block 1004, a user is prompted to make a beverage type selection. Such a beverage type selection may be made on a graphical user interface 206A by a consumer or on a graphical user interface 206B by a crew-server member. In block 1006, a number of indicia may be printed on the vessel 212. Such indicia may be printed by way of a vessel printer 236 or otherwise. In addition, such indicia may be the type or kind of beverage selected and dispensed, a barcode that is machine readable, health and wellness information, product contents information, consumer loyalty data, and/or other type of information.

In block 1008, the vessel 212 may be relocated to the beverage dispensing station or an automated beverage system. The vessel 212 may be handed to the consumer or the automated beverage system may begin to fill the order. In block 1010, the indicia may be read on the surface of the vessel 212 at the beverage dispensing station or the automated beverage system. In block 1012, the beverage dispensing station or the automated beverage system may be configured to dispense the beverage type selected. In block 1014, the beverage type selected may be dispensed into the vessel 212. The method is then exited.

Figure 9:
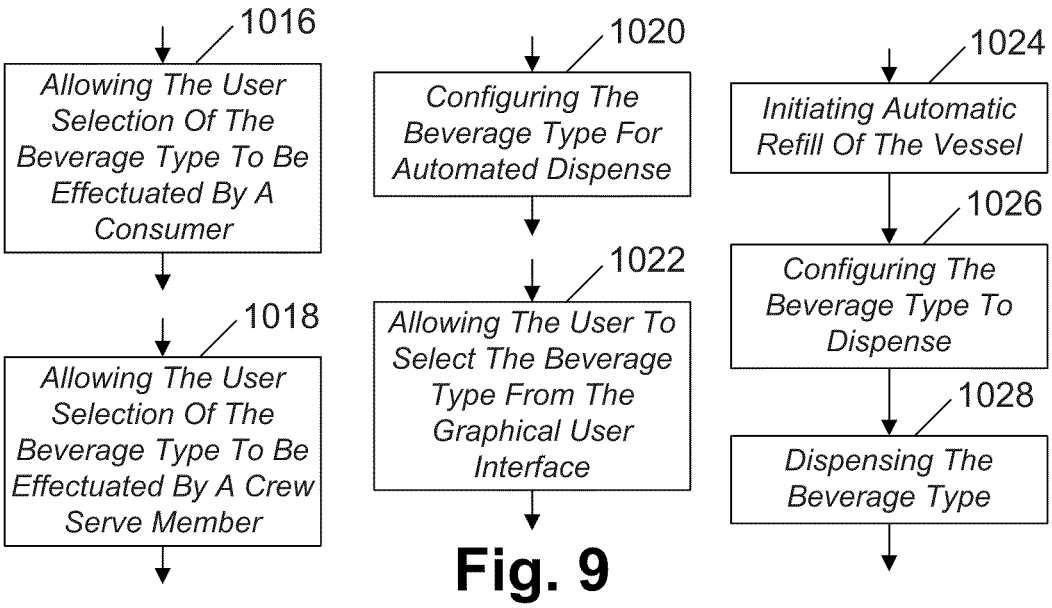
FIG. 9 illustrates examples of exemplary embodiments of a method of selecting and dispensing beverages using a vessel as part of a user interface device.

Referring to FIG. 9, examples of a method for managing orders and dispensing beverages are shown. In block 1016, the selection of the beverage type may be effectuated by a consumer. In this regard, the consumer may have access to a beverage selection graphical user interface. In block 1018, the selection of the beverage type may be effectuated by a crew member. The crew member may have access to the beverage selection graphical user interface. In block 1020, the steps of reading indicia from the vessel 212, configuring the beverage dispenser, and dispensing the beverage type into the vessel 212 may be performed in an unattended manner by way of the automated beverage system. Upon order entry, the vessel 212 may be filled without the intervention of a crew member. In block 1022, the user may be allowed to select the beverage type from the graphical user interface by moving and/or rotating the vessel 212. In block 1024, an automatic refill of the vessel 212 may be initiated by reading the printed indicia on the surface of the vessel 212 at the beverage dispensing station. In block 1026, the beverage dispensing station may be configured to dispense the beverage type based on the indicia read on the surface of the vessel 212. In block 1028, the selected beverage type may be dispensed into the vessel 212. The method is then exited.

Figure 10:
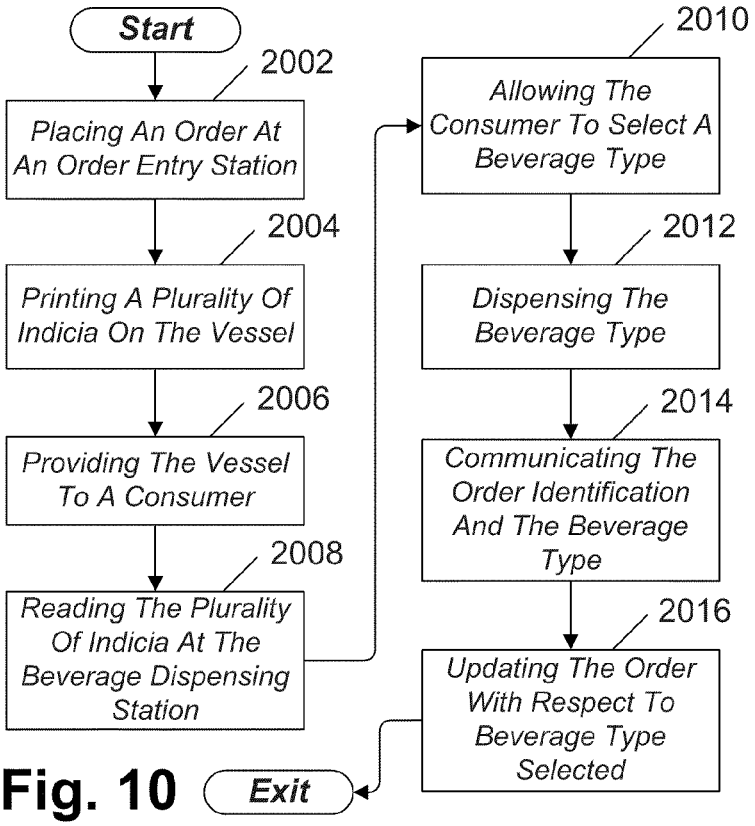
FIG. 10 illustrates one example of a method for managing orders and dispensing beverages.

Referring to FIG. 10, one example of a method for managing orders and dispensing beverages is shown. An order may be placed at an order entry station and a vessel 212 may be printed with indicia and provided to a consumer. The printed indicia may include order identification indicia. The consumer may then present the indicia printed on the vessel 212 for reading at a beverage dispensing station. The beverage dispensing station may allow the consumer to select a beverage type and the beverage may be dispensed into the vessel 212. A data communication between the beverage dispensing station and the order entry data processing system may then be effectuated that includes order identification data and the beverage type data. This data communication may serve to update the order with respect to the beverage type selected, as well as update other aspects of the order. The method begins in block 2002.

In block 2002, an order at an order entry station may be placed. In block 2004, a number of indicia may be printed on the vessel 212. Such indicia may include the order identification and other information. In block 2006, the vessel 212 may be provided to the consumer. In block 2008, the indicia may be read at the beverage dispensing station by the system 300. In block 2010, the consumer may be allowed to select a beverage type. In block 2012, the beverage type may be dispensed into the vessel 212. In block 2014, the order information and the beverage type also including the volume dispensed and other attributes of the beverage product may be data communicated to a data processing resource such as data processor 244 or to a global network based data processing resource. In block 2016, the order with respect to the beverage types selected and the order identification received may be updated. In this regard, the consumer's order may now track the beverage type and other beverage attributes based in part of the beverage type dispensed. The method is then exited.

Figure 11:
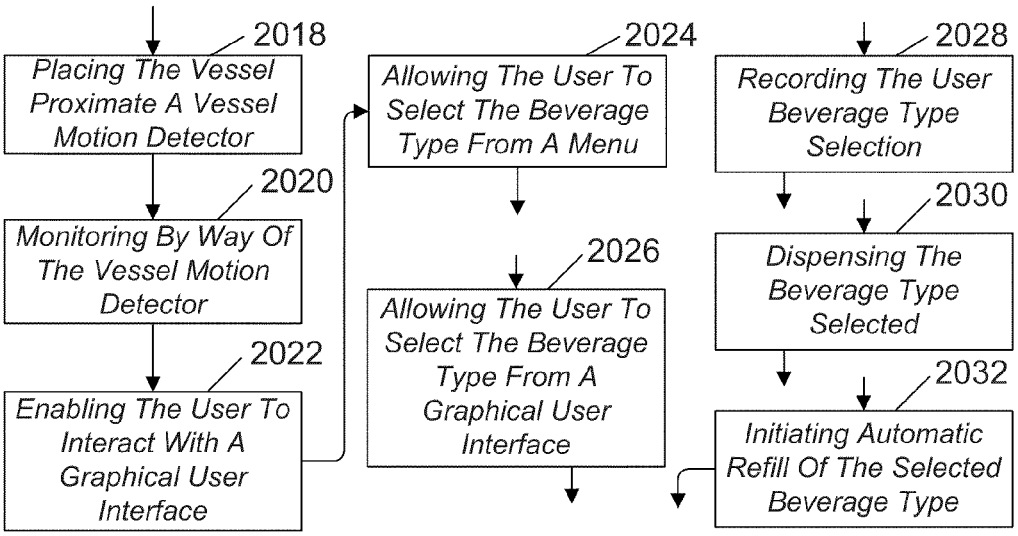
FIG. 11 illustrates examples of exemplary embodiments of a method for managing orders and dispensing beverages.

Referring to FIG. 11, methods for managing orders and dispensing beverages are shown. In block 2018, the vessel 212 may be placed proximate to a vessel motion detector 304.

In block 2020, the rotation and other motion of the vessel 212 may be monitored. In block 2022, the user may be allowed or enabled to interact with the graphical user interface. In block 2024, the user may be allowed to select the beverage type from a menu. The method is then exited.

In another example in block 2026, the user may be allowed to select the beverage type from the graphical user interface by moving and/or rotating the vessel 212. In block 2028, the beverage type selection may be recorded. A tap or movement of the levers or switches associated with or monitored by the system 300 may be sufficient to indicate the user's intent to record a user selection. In block 2030, the user may effectuate the dispensing of the beverage type selected. In block 2032, the user may initiate an automatic refill of the vessel 212 with the selected beverage type. The beverage dispensing station may be configured to dispense the beverage type based on the indicia and the beverage type may be dispensed into the vessel 212.

Figure 12:
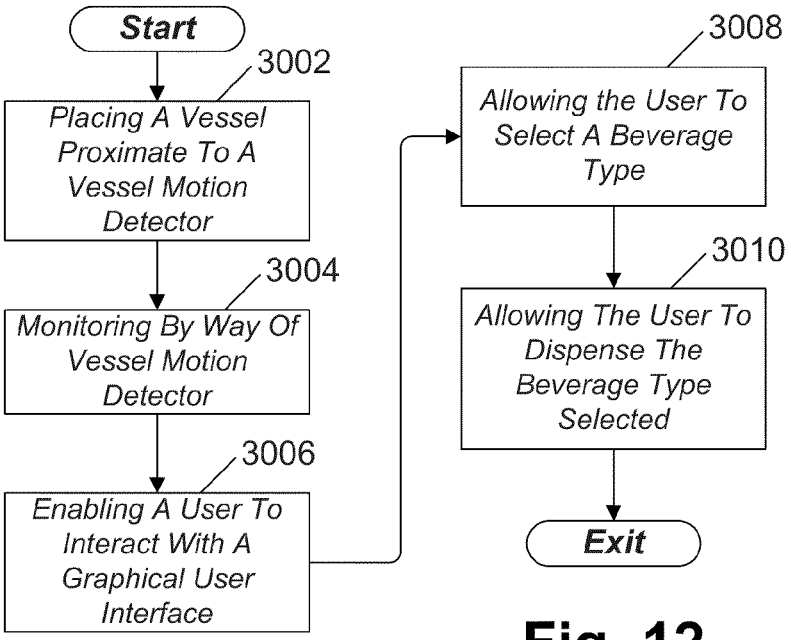
FIG. 12 illustrates one example of a method of using a vessel as graphical user interface pointing device on fountain dispensers.

Referring to FIG. 12, an example of a method of using a vessel as graphical user interface pointing device on fountain dispensers is shown. The vessel 212 may be placed proximate to a vessel motion detector 304. The rotation or other movement of the vessel 212 may be monitored by way of the vessel motion detector 304. A user may be allowed, or otherwise enabled, to interact with the graphical user interface by way of using the vessel 212 as a pointing device. The user may then select and dispense a beverage type. The method begins in block 3002.

In block 3002, the vessel 212 may be placed proximate to a vessel motion detector 304. In block 3004, the rotational and other motion of the vessel 212 may be monitored. In block 3006, a user may be allowed or otherwise enabled to interface with the graphical user interface. In block 3008, the user may be allowed to select a beverage type. In block 3010, the user may be allowed to dispense the beverage type selected into the vessel 212. The method is then exited.

Figure 13:
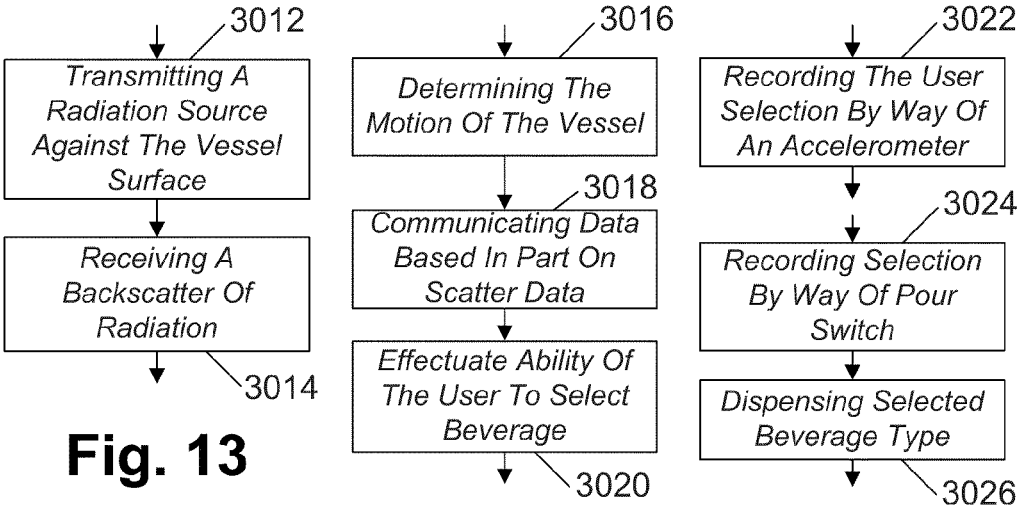
FIG. 13 illustrates examples of exemplary embodiments of a method of using a vessel as graphical user interface pointing device on fountain dispensers.

Referring to FIG. 13, examples of a method of using the vessel 212 as a graphical user interface pointing device on fountain dispensers are shown. In block 3012, a radiation source such as a monochromatic light, laser, or other radiation source, may be transmitted against the surface of the vessel 212. In block 3014, scatter data, also referred to as backscatter, may be received at the vessel motion detector. Such scatter data may be associated with the motion of the vessel. The microprocessor implements instructions for effectuating the ability of the user to rotate or move the vessel 212 to select a beverage type. The method is then exited.

In another example in block 3016, a microprocessor may be interconnected with the vessel motion detector so as to receive reflected radiation off the surface of the vessel 212 from the radiation source as scatter data associated with the motion of the vessel 212. The microprocessor may implement instructions that perform the steps of determining the motion of the vessel 212 by analysis of the scatter data. In block 3018, the data may be communicated based in part on the scatter data that enables the user to interact with the graphical user interface. In block 3020, the ability of the user to rotate or move the vessel 212 to select a beverage type may be effectuated. The method is then exited.

In another example in block 3022, the user's selection may be recorded by way of an accelerometer. Such tapping or lever movement may be detected by the user selection detector and used to confirm the selection of the beverage type. In operation, this confirmation of the selected beverage type may be followed by the dispensing of ice, the beverage, and/or other actions.

In another example in block 3024, the user's selection may be recorded by way of the activation of a pour switch. In block 3026, such pour switch activation may effectuate the dispensing of the beverage type selected. The method is then exited.

In another example, the printed indicia may be printed on the bottom of the vessel, and may be read by a system 300 configured to read the indicia from the vessel bottom. This may advantageously be achieved directly under the valve, e.g., 218, or other dispenser head, e.g., in the embodiment of FIG. 1.

The capabilities herein may be implemented in software, firmware, hardware or some combination thereof. As one example, one or more aspects described herein may be included in an article of manufacture (e.g., one or more computer program products) having, for instance, computer usable media. The media may have embodied therein, for instance, computer readable program code means for providing and facilitating the capabilities herein. The article of manufacture may be included as a part of a computer system or sold separately. Additionally, at least one program storage device readable by a machine, tangibly embodying at least one program of instructions executable by the machine to perform the capabilities described herein may be provided.

The flow diagrams depicted herein are just examples. There may be many variations to these diagrams or the steps (or operations) described herein without departing from the spirit of the invention. For instance, the steps may be performed in a differing order, or steps may be added, deleted, or modified. All of these variations are considered a part of the claimed invention.

Although several embodiments of the invention have been described, it will be understood that those skilled in the art, both now and in the future, may make various improvements and enhancements that fall within the scope of the claims that follow and the equivalents thereof. These claims should be construed to maintain the proper protection for the invention first described.

We claim:

1. A method for managing orders and dispensing products, comprising:

prompting a user selection of a product type at an order entry station;

allowing a user to select the product type from a product selection graphical user interface by moving or rotating a container;

printing indicia on the container indicating at least the product type selected;

reading the indicia at a product dispensing station; and dispensing the product type selected into the container.

2. The method of claim 1, wherein prompting the user selection of the product type further comprises prompting a consumer, the consumer having access to the product selection graphical user interface.

3. The method of claim 1, wherein prompting the user selection of the product type further comprises prompting a crew member, the crew member having access to the product selection graphical user interface.

4. The method of claim 1, wherein reading indicia from the container and dispensing the product type into the container are performed in an unattended manner by way of an automated product dispensing system.

5. The method of claim 1, further comprising initiating a refill of the container with the selected product type by reading the indicia on the container at the product dispensing station.

6. A method for managing orders and dispensing beverages, comprising:

placing an order at an order entry system, the order including an order identification;

printing indicia on a vessel including the order identification;

providing the vessel to a consumer;

reading the indicia at a beverage dispensing station;

allowing the consumer to select a beverage type from a graphical user interface by moving or rotating the vessel;

dispensing the beverage type into the vessel; and updating the order with respect to beverage type selected.

7. The method of claim 6, wherein allowing the consumer to select the beverage type from the graphical user interface by moving or rotating the vessel further comprises:

placing the vessel proximate to a vessel motion detector;

monitoring, by way of the vessel motion detector, vessel rotational or other motion;

enabling the consumer to interact with the graphical user interface via the vessel motion detector; and allowing the consumer to select the beverage type from a menu of beverages displayed on the graphical user interface.

8. The method of claim 6, further comprising initiating a refill of the vessel with the selected beverage type by reading the indicia on the vessel at the beverage dispensing station.

9. The method of claim 6, further comprising recording the selected beverage type.

10. The method of claim 6, further comprising dispensing a refill of the selected beverage type into the vessel and updating the order with respect to the number of beverage refills.

* * * * *